United States Patent [19]

Schandle et al.

[11] Patent Number: 4,461,221

[45] Date of Patent: Jul. 24, 1984

[54] SYSTEM FOR DETAINING ROBBERS ON PREMISES

[76] Inventors: Alfred J. Schandle, 31 Boston Post Rd., Westbrook, Conn. 06498; Andrew G. Bakoledis, 12 Reservoir Rd., Clinton, Conn. 06413

[21] Appl. No.: 429,603

[22] Filed: Sep. 30, 1982

[51] Int. Cl.[3] ..... E05G 5/02

[52] U.S. Cl. ..... 109/6; 109/3

[58] Field of Search ..... 109/2, 3, 6, 32, 1 R, 109/31

[56] References Cited

U.S. PATENT DOCUMENTS

| | | | |
|---|---|---|---|
| 2,560,410 | 7/1951 | Brown | 109/6 |
| 3,068,810 | 12/1962 | Kaloshin | 109/6 |
| 3,413,934 | 12/1968 | Giacobbe | 109/6 |
| 3,779,178 | 12/1973 | Riseley | 109/6 |

FOREIGN PATENT DOCUMENTS

| | | | |
|---|---|---|---|
| 2142484 | 3/1973 | Fed. Rep. of Germany | 109/3 |
| 2211841 | 9/1973 | Fed. Rep. of Germany | 109/6 |
| 2448024 | 10/1980 | France | 109/3 |
| WO79/3178 | 7/1979 | PCT Int'l Appl. | 109/2 |
| 1299303 | 12/1972 | United Kingdom | 109/2 |

*Primary Examiner*—Gene Mancene
*Assistant Examiner*—John G. Weiss
*Attorney, Agent, or Firm*—William W. Jones

[57] ABSTRACT

A system of detaining a robber on the premises robbed after the robbery has taken place. The premises is provided with lobby entrances having inner and outer doors through which persons entering and leaving the premises must pass. Once a robbery commences, the doors to the lobbies are automatically locked. In the money handed to the robber, there is concealed a radio transmitter which transmits a narrow wave length signal. Mounted in the wall adjacent to each lobby inner door inside the premises proper there is mounted a receiver which is tuned to the narrow wave length and which has a limited range of reception on the order of about five feet or so. When the transmitter carried by the robber is within the receiving range of the receiver, the inner lobby door can be opened from inside the premises. Once the robber enters the lobby, neither of the lobby doors can be opened by the robber and he will be caught in the lobby.

14 Claims, 10 Drawing Figures

SYSTEM FOR DETAINING ROBBERS ON PREMISES

This invention relates to a security system for use in banks or other locations which are subject to armed robbery. The system of this invention can be installed by modifying existing building structure by installing a prefab modular structure to create a double door enclosure at each entrance and exit of the premises.

Banks and other places where large sums of money are kept are, of course, prime targets for robberies, which are, more often than not, successful in that the robber or robbers usually are able to flee the premises with the stolen money in hand. These robberies usually occur during working hours when the bank is full of people. The likelihood that innocent bystanders will be exposed to possible danger during such a robbery, by and large, prevents bank officials from taking positive steps to try to capture the robbers before they can escape with the stolen money. Generally, the only steps taken by bank employees during a robbery will be to activate systems which photograph the robbers, and to activate silent alarms which will be detected at a remote security office or the police station so as to inform the authorities that the robbery is in progress. Otherwise, tellers are instructed to cooperate with robbers so as not to risk injury to themselves or others in the bank. The photographs taken of the robbers may be, but are not always, helpful in apprehending the robber after the crime has been committed. Likewise, the silent alarms will bring the authorities to the bank, but generally after the robbers have escaped.

The system of this invention is designed to trap the robbers on the bank premises after the robbery has been committed so that the robbers cannot escape with the stolen money. The system, once activated, operates automatically but can be overridden in case of some unexpected occurrence. Other systems have been described in the prior art for detaining bank robbers or the like on the premises of the bank after or before the robbery has taken place.

Illustrative of the prior art systems for detaining bank robbers are those disclosed in U.S. Pat. No. 2,560,410, issued July 10, 1951 to J. H. Brown, and U.S. Pat. No. 3,779,178, issued Dec. 18, 1973 to G. F. Riseley, Jr. Both of these disclosures include the concept of detaining a bank robber in the entrance vestibule of a bank so that the robber cannot escape or harm others in the bank.

The system of this invention operates generally as follows. Each entry to the bank or other premises through which customers enter and leave the bank is provided with a lobby or foyer having an outer door and an inner door. One enters the lobby from outside of the bank through the outer door and enters the business area of the bank from the lobby through the inner door. Opening and closing of the outer and inner doors of the lobby is controlled by push buttons or other manually actuable means, much like elevator doors are controlled. One wishing to enter the bank from the outside pushes the outer door push button causing the outer door to open whereupon access to the lobby is had. Once one enters the lobby, the outer door closes automatically and the inner door push button must be pushed to open the inner door whereupon access to the main part of the bank is had. After one passes through the inner door into the bank proper, the inner door automatically closes again. The outer and inner doors are preferably sliding doors which are operated by electric motors to open and close. From the above, it will be noted that a would-be robber can enter the bank just like any other customer.

Each teller, or other dispenser of cash in the bank, will have at their position a special or target packet of currency which is kept at all times in a special section in the cash drawer. That special section of the cash drawer is equipped with a detector which will automatically sense removal of the target currency packet from the special cash drawer section. The detector can be photoelectric, pressure sensitive, or the like operated, and the detector automatically causes a number of things to occur inside and outside of the bank upon removal of the target currency packet. Inside of the target currency packet there is hidden a miniaturized signal transmitter which has a predetermined signal transmission range of preferably about one mile. At each teller station, there is disposed a teller position screen wherein all of the other teller stations are identified by number. Such teller position screens are also positioned at each desk or work station in the bank. All of the teller position screens are out of sight of bank customers but in full view of the person working at the various sites throughout the bank.

When cash is demanded by a robber, the teller being confronted will take the target currency packet along with other currency in the cash drawer and give it all to the robber in a bag or however the robber demands it. Removal of the target currency packet from the special cash drawer section causes the number of the teller being robbed to light up on all of the teller position screens in the bank so that all bank employees viewing such screens will know that a robbery is in progress and which teller is being robbed. This permits the other tellers and bank employees to detain customers on various pretexts in order to protect the customers from becoming inadvertantly involved with the robber or robbers. Removal of the target currency packet also activates a hidden camera which photographs the robber, activates a silent alarm at the police or other outside security station, activates a sign or signs outside the bank at each entry notifying that a robbery is in progress inside the bank, and automatically locks both the inner and outer doors of each customer entry in the closed position. In the event that customer entering or leaving the bank happens to be in the lobby when the doors are automatically locked, the inner doors can be opened once after automatic locking by pressing the inner door button inside the lobby so that such customers can enter the bank proper. A signal receiver having an operable receiving range on the order of four to five feet or so and operating on the same wave length as the transmitter in the target currency packet is mounted in the wall adjacent to each of the inner lobby doors inside the bank proper. This receiver is operable to enable one in the bank to open the inner lobby door by pressing on the inner lobby door button in the bank proper only when the target currency packet transmitter is within the predetermined short distance receiving range of the receiver. Otherwise, the inner lobby door cannot be opened from inside the bank proper. Thus, as the robber approaches the inner lobby door with the stolen money, he will be able to open the inner lobby door and enter the lobby due to the fact that he will be carrying the target currency packet along with the rest of the stolen money. Once the robber enters the lobby, he will not be able to open either the inner or outer lobby doors and will be trapped in the lobby. A two-way communication arrangement will be present so that communication can be had with the robber from both inside and outside of the bank. A heavy metal detector will be operable at each lobby to detect whether the robber possesses a firearm, and a receptacle will be disposed in the lobby where the robber will be instructed to deposit any firearms in his possession. Once the robber has been disarmed, the lobby can be opened from the outside by police with a special magnetic card, key, or other device so that the robber can be removed. Once the robber has been safely removed from the bank lobby, the entire system is reset by a master switch and business in the bank can resume in a normal fashion.

It is, therefore, an object of this invention to provide a security system for a bank or other similar location wherein all entries to the facility will be provided with lobbies having inner and outer doors, in which lobbies a robber can be detained.

It is a further object of this invention to provide a security system of the character described wherein the inner and outer lobby doors must be opened by actuation of a switch by one entering or leaving the premises.

It is yet another object of this invention to provide a security system of the character described wherein the inner and outer lobby doors will be automatically locked once a robbery is in progress.

It is an additional object of this invention to provide a security system of the character described wherein the inner lobby door, once locked, can only be released for opening from the inside by a transmitter-receiver combination, with the transmitter being, unbeknownst to the robber, given to the robber during the robbery.

It is another object of this invention to provide a security system of the character described wherein the identity of the teller or other person being robbed will be automatically made known to other employees of the premises.

These and other objects and advantages of the invention will be more readily apparent to those skilled in the art from the following detailed disclosure of a preferred embodiment of the invention taken in conjunction with the accompanying drawings, in which.

Figure 1:
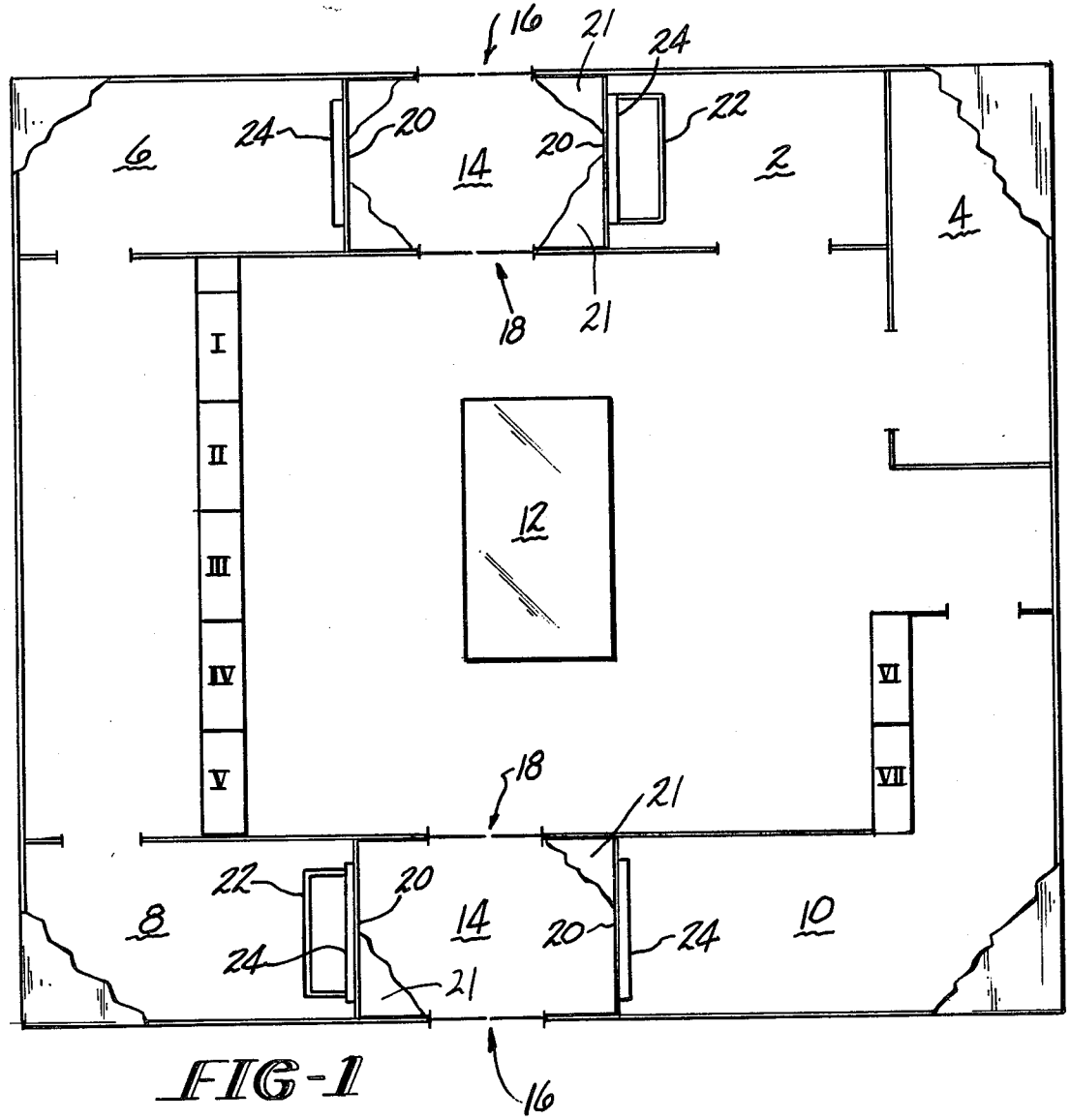
FIG. 1 is a plan view of a conventional bank facility in which the system of this invention has been installed.

Referring now to the drawings, there is shown in FIG. 1 a plan view of a typical banking facility. The teller stations are identified by Roman numerals I–VII. The rooms 2 and 4 can be used for loan officers, the bank manager, or other bank personnel. The vaults and/or safety deposit boxes can be located in areas 6, 8 or 10. The counter 12 is where bank forms and slips for customers are typically kept and where deposit forms and the like are customarily filled out before going to a teller station. The areas 14 are lobbies used for entering and exiting from the bank. These are the only areas that customers can use to enter and leave the bank premises. Many banks are currently built with such lobbies, and if not, the lobbies can be installed in existing buildings in modular form. Each lobby 14 has an outer door 16 and an inner door 18, side walls 20 and top or ceiling walls 21. The outer and inner doors 16 and 18 are normally closed and must be opened by customers going in either direction by some manually actuable means, such as a push button which will energize an electrical door opening mechanism, such as a motor or the like. The motor can be mounted in the ceiling of the lobby structures or in the door jamb. It will be understood that the lobbies will be of sufficient length between inner and outer doors so that the door used to enter the lobby will reclose before the door used to exit the lobby will open. The doors 16 and 18 cannot be manually opened in any other fashion. The doors 16 and 18, and side walls 20 of the lobbies are constructed of a bullet proof material. The doors 16 and 18 are preferably sliding doors which retract into pockets in the adjacent walls when the "open" button is used, and then automatically return to the closed position. There is associated with each lobby 14 a weapon receptacle 22 which will be described in greater detail hereinafter. Each lobby 14 is also fitted with heavy metal detectors 24 in or adjacent to the walls 20 so that bank or police personnel can determine whether a person being detained in the lobby possesses a firearm prior to releasing that person from the lobby. If it is determined that such person does possess a firearm, then that person will be instructed to place the firearm in the weapon receptacle before they will be released. In this manner, bogus firearms can also be identified as such.

Figure 2:
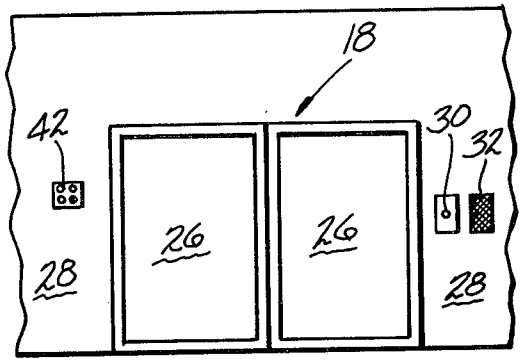
FIG. 2 is a fragmented elevational view showing the inside of one of the inner lobby doors.

Referring now to FIG. 2, an elevational view of the inner door 18 to the lobby is shown. It will be appreciated that the inner door to each lobby will be identical in construction. Each inner lobby door 18 preferably includes one or more sliding doors 26 which, when opened, slide into pockets in the adjacent walls 28. Mounted on the wall 28 there is a push button 30 which, when depressed, actuates an electrical circuit which operates a motor which automatically opens and closes the doors 26. Also mounted on the wall 28 is a radio receiver 32 which receives a narrow band signal from a transmitter, as will be set forth in greater detail hereinafter. It will be appreciated that the elevational views of the inner side of both the inner and outer lobby doors 16 and 18 is the same as shown in FIG. 2, except that the receiver 32 will not be present inside of the lobbies 14.

Figure 3:
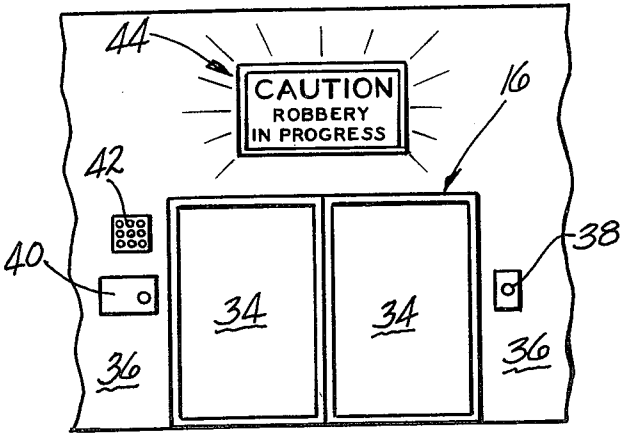
FIG. 3 is a fragmented elevational view showing the outside of one of the outer lobby doors.

Referring now to FIG. 3, there is shown the outside of the outer lobby doors 16. Each outer lobby door 16 preferably includes one or more sliding doors 34 which, when opened, slide into pockets in the adjacent walls 36. Mounted on the wall 36 is a push button 38 which, when depressed, actuates an electrical circuit which operates a motor which automatically opens and closes the doors 34. Also mounted on the wall 36 is an override device 40 which can be operated by police or other security personnel with a magnetic card, a special key, or the like, to open the outer doors 34 to release a person detained therein in order to take custody of such person. An intercom unit 42 is mounted on the wall 36 so that when someone is detained in the lobby, the police or other security personnel can communicate with such person from outside of the lobby. Similar means are provided for communicating with such person from inside the bank proper. Mounted above the door 16 is a sign 44 which is only actuated when a robbery is in progress. The wording of the sign is normally not visible to persons outside the bank, but becomes visible during a robbery to warn those outside the bank. The letters in the sign can be LED activated and the sign can flash off and on if so desired to attract people's attention. Mounted inside of each lobby there is a second intercom receiver-transmitter which operates in conjunction with the intercom 42 and over which can also be played a pre-recorded message to the robber in the lobby to explain the situation to him.

Figure 4:
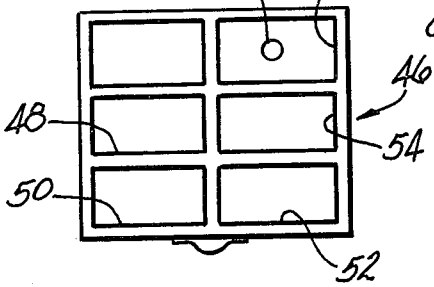
FIG. 4 is a plan view of a teller's cash drawer showing the money compartments and the special compartment in which the target money packet is kept.

The special cash drawers 46 which are used in conjunction with the system of this invention are shown in plan view in FIG. 4. Each drawer 46 will be provided with five or more compartments 48, 50, 52, 54 and 56 in which bills are stacked. The compartments 48, 50, 52 and 54 hold conventional currency and are used in the normal transaction of bank business by the tellers. These compartments can, for example, be used to hold bills such as one dollar, five dollar, ten dollar, and twenty dollar denominations which are most commonly used by tellers in transacting bank business. The compartment 56 is used to hold the target currency packet which contains a miniature radio transmitter of limited range which transmits on the frequency of the wall mounted receivers 32. The compartment 56 is thus positioned in a relatively obscure location near the rear of the drawer 46 so it will not interfere with the transaction of normal bank business, but it will be readily accessible for its purpose, in the case of a robbery. Mounted in the compartment 56 is a sensor 58 which is operative to close an electrical switch, as will be set forth in greater detail hereinafter, when the target currency packet is removed from the compartment 56. The sensor 58 can be a photoelectric device, a pressure device, or some other conventional type of sensor.

Figure 5:
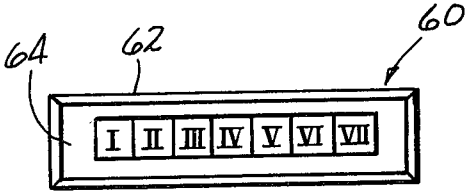
FIG. 5 is an elevational view of a teller position board which alerts employees to the existence of a robbery in progress.

Referring now to FIG. 5, There is shown a teller position indicator of the type used in the system of this invention. There will be one of these indicators at each employee position in the bank so that all employees will know when there is a robbery in progress and which teller or tellers are being robbed. The indicators are positioned out of the general public's view but in plain view of each of the respective bank employees. The indicator 60 includes a container 62 having a transparent or transluscent cover 64. On the cover 64, there are printed in Roman numerals the numbers I–VII, there being one for each teller station. Inside of the container 62, there is disposed a bank of lights, one beneath each Roman numeral, with each of the lights being connected to the specific teller station which it identifies. When a target packet of currency is removed from one of the cash drawer compartments 56 by a teller during a robbery, the light identifying the teller being robbed will light up on all of the teller indicators 60 in the bank thus alerting everyone employed in the bank to the robbery, and identifying the teller being robbed.

Figure 6:
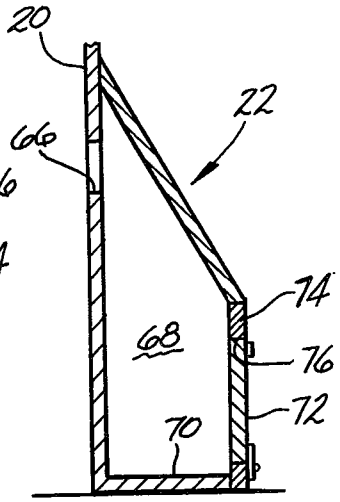
FIG. 6 is a vertical sectional view of the weapons discard container used in conjunction with each lobby.

Referring now to FIG. 6, details of the firearm receptacles 22 associated with the lobbies are shown. The sidewall 20 of the lobby is provided with an opening 66 which is large enough to pass a firearm through. The opening 66 opens from the lobby into the interior 68 of the firearm receptical 22. The distance between the opening 66 and the bottom 70 of the receptical 22 is such that one cannot reach through the opening 66 from the lobby to retrieve a firearm dropped into the receptical 22. A door 72 is disposed on the far wall 74 of the receptical 22 so that bank personnel can gain access to the interior 68 of the receptical 22 through an opening 76 to remove firearms dropped into the receptical 22.

Figure 7:
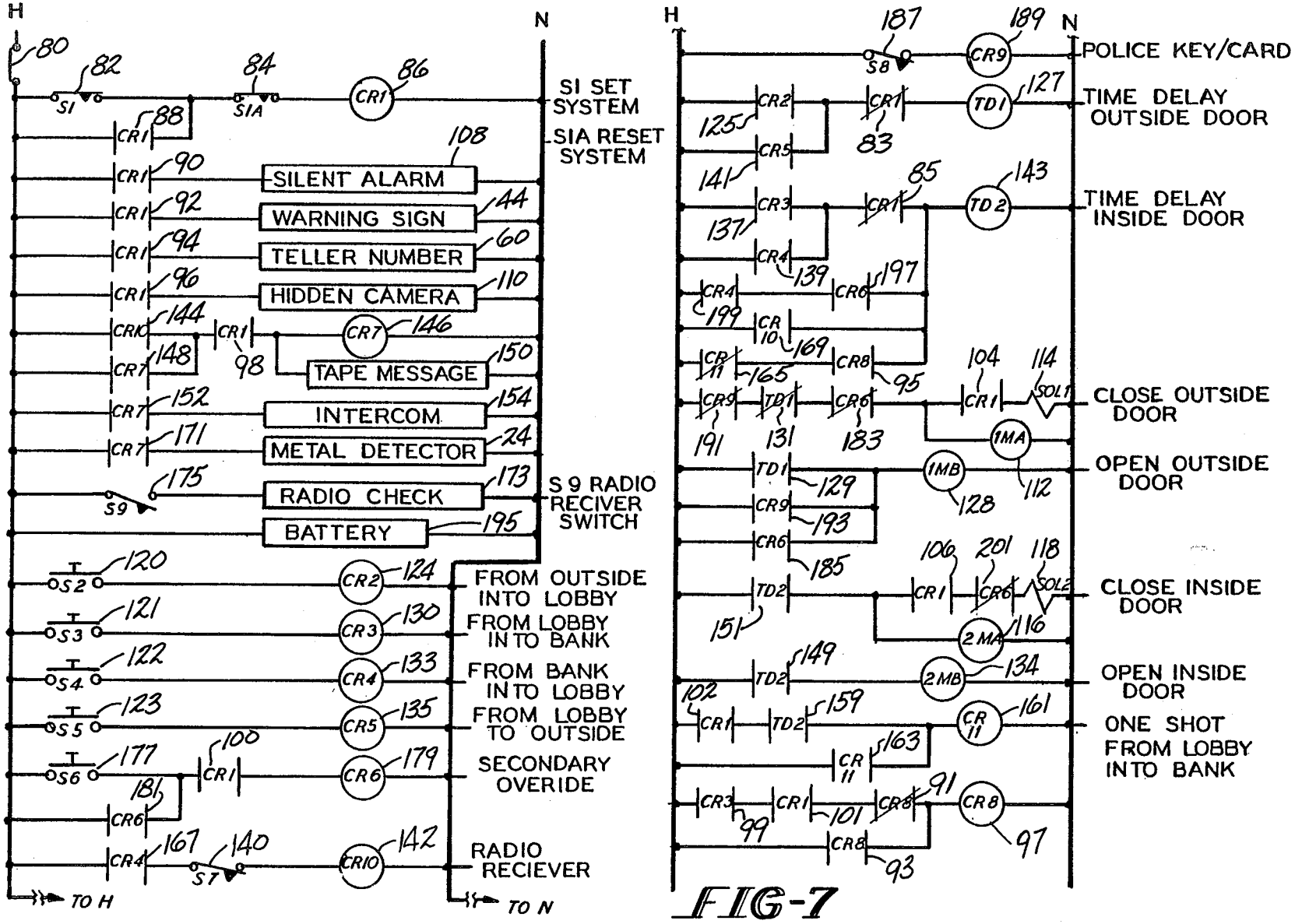
FIG. 7 is a circuit diagram of the arming circuity used in providing a preferred embodiment of the system of this invention and for normal operation of the lobby doors.

Referring now to FIG. 7, the circuitry for operating the system of this invention is shown. The letter H designates the hot line and the letter N designates the neutral line in the electrical circuit which energizes the system. The switch 80 is a manually operated master switch which is turned on at the start of the business day to energize the system and which is turned off at the end of the business day to de-energize the system, since the system of this invention is intended for use only during banking hours and is not intended to be used as a twenty-four hour security system. The switch 82 is a normally open switch which is actuated by the sensor 58 in the tellers' cash drawers, and which closes automatically when the target cash packet carrying the transmitter is removed from any of the cash drawer compartments 56 (see FIG. 4). For clarity, the switch 82 is shown closed indicating that a robbery is in progress. The switch 84 is a reset switch which is normally closed and which is only opened manually to disable the security system in case of emergency. There will be one or more of these switches at various key personnel locations throughout the premises. When the switches 80, 82 and 84 are closed, the relay coil 86 is energized. Energization of the relay coil 86 closes the normally open switch 88 thereby bypassing the switch 82 while the robbery remains in progress. The energized relay coil 86 also closes the switches 90, 92, 94, 96, 98, 100, 102, 104 and 106. Closing of the switch 90 activates the silent alarm 108 which sounds at a police station or other security location off of the premises to alert personnel at such locations that a robbery is taking place at the premises. Closing of the switch 92 activates the warning sign 44 (see FIG. 3). Closing of the switch 94 lights up the appropriate teller number on the teller position indicator 60 (see FIG. 5) to warn other bank personnel that a robbery is in progress. Closing of the switch 102 is a preparatory step for allowing the inner lobby doors to be opened once to free a customer accidentally caught in the lobby when the target cash packet is removed from its compartment 56. Closing of the switch 104 energizes a solenoid 114 which operates a locking mechanism such as a dead bolt or other locking mechanism mounted in the wall adjacent the doors 34 to throw the locking mechanism into a locking position thereby locking the outer lobby doors 34 in a closed position. It will be noted that the numerals 112 and 116 refer to the door closing contacts for the outside and inside lobby doors respectively and the numerals 128 and 134 refer to the door opening contacts for the outside and inside lobby doors, respectively. Closing of the switch 106 energizes a solenoid 118 which operates a locking mechanism mounted in the wall above the doors 26 to throw the locking mechanism into a locking position thereby locking the inner lobby doors 26 in a closed position. Closing of the switch 100 is a preparatory step for using the secondary override switch to release a robber from the lobby in case of the taking of a hostage, as will be explained in greater detail hereinafter.

The manually operable switches 120, 121, 122 and 123 are the switches which open the inner and outer lobby doors 26 and 34 in the normal course of entry and exit by banking customers. The switch 120 is operated by the push button 38 to open the outer lobby door 34 to enter the lobby from outside the bank. The switch 121 is operated by a push button located inside of the lobby to open the inner lobby door 26 to enter the bank proper from the lobby. The switch 122 is operated by the push button 30 inside the bank proper to open the inner lobby door 26 to enter the lobby from the bank proper. The switch 123 is operated by a push button located inside of the lobby to open the outer lobby door 34 to exit from the lobby to outside of the bank. When the switch 120 is closed by pressing the outer lobby door push button 38, the control relay 124 is energized closing switch 125 to energize time delay relay 127 which closes switch 129 and opens switch 131 for a preset time period to energize the outside motor relay coil 128. Motor relay coil 128, when energized, closes the outside door motor contacts to open the outside doors 34 to allow one to enter the lobby from outside of the bank. After the preset time period has expired, the switch 129 reopens and the switch 131 recloses. When the switch 131 recloses, the motor relay coil 112 is energized closing the reverse motor contacts which causes the doors to close once again. Similarly, operation of the switches 121, 122 and 123 selectively energizes their respective associated control relays 130, 133 and 135, which in turn, selectively close switches 137, 139 and 141, respectively, to selectively energizes their associated time delay relays 143 and 127.

Time delay relay 143, when energized, closes switch 149 to energize inside motor relay coil 134 and concurrently opens switch 151 to de-energize inside motor relay coil 116. Thus, the inside lobby doors 26 will open when the inside lobby door button inside of the lobby is pressed. After the time delay, the switch 149 reopens and the switch 151 recloses to reclose the inside lobby doors 26.

Thus, the switches 125 and 141 activate the time delay relay 127 for the outer lobby doors, and the switches 137 and 139 activate the time delay 143 for the inner lobby doors.

It will be noted that when the control relay 86 is energized, the switches 83 and 85 will open so that the time delay relays 127 and 143 cannot be energized by the switches 125 and 141 or 137 and 139, respectively, while a robbery is in progress.

As previously noted, when robbery is in progress, the switch 102 will all of the lobby doors will close and lock. Should someone entering the bank be caught in a lobby when the lobby doors are locked shut, they need merely press the inside lobby door button located in the lobby. Pressing this button will close switch 159 activating control relay 161 which closes switch 163 and opens switch 151. Thus, the inside solenoid lock 118 will be momentarily de-energized, along with the motor contacts 116. Switch 149 will close and motor contacts 134 will be energized to open the inside lobby doors. Pressing the inside lobby inside door button activates control relay 130 which, in turn closes switch 99. When control relay 86 has been activated, switch 101 will close so that closing switch 99 activates control relay 97. Control relay 97 closes switches 95 and 93, while opening switch 91. Energization of relay coil 161 also opens switch 165 so that time delay relay 143 can only open the inside lobby doors once after a robbery has commenced. It will be understood that the electric motors which open and close the doors are reversable motors which operate when a push button is depressed to open the doors and then, after a suitable time delay, automatically reverse to subsequently close the doors.

As previously noted, the switch 122 is operated by the push button 30 located inside the bank proper to open the inner doors 26 which lead from the bank proper to the lobby. The switch 140 is controlled by the radio receiver receiving a signal from the radio transmitter contained in the target packet of money in the possession of the robber. As previously noted, the receiver in the lobby wall has a limited range on the order of four to five feet, and when the robber comes within that range with the hidden transmitter in his possession, the signal from the transmitter being received by the receiver will cause the switch 140 to close. When the switch 140 is closed due to the proximity with the transmitter, the switch 122 will be operable, through relay coil 133 closing switch 167, to actuate a time delay relay 142 which will be actuated for a preset time period. The time delay relay 142 deactivates the solenoid lock 118 by closing switch 169 to activate time delay relay 143 which opens switch 151. At the same time, time delay relay 143 closes switch 149 which allows the motor relay coil 134 to energize closing the motor contacts to open the inside doors 26 to allow the robber to enter the lobby from inside the bank. It will be noted that up to this point, the robber will not be aware that anything out of the ordinary is happening. Once the robber enters the lobby, the inner lobby doors 26 will close behind him and he will not be able to reopen the inner lobby doors 26 or open the outer lobby doors 34 from inside the lobby due to the activation of the outer solenoid lock 114 and reactivation of the inner solenoid lock 118. The time delay relay 142 also closes a switch 144 which activates the coil relay 146. Activation of the coil relay 146 closes a switch 148 which energizes a tape playback system 150. The tape playback system 150 broadcasts a pre-recorded message to the robber caught in the lobby explaining the situation to the robber and telling him that he cannot escape from the lobby and telling him that police or other security are on the way to the bank. The relay coil 146 also closes a switch 152 which energizes the intercom system 154 so that communication can be had with the trapped robber from inside the bank proper and from outside of the bank via the intercom units 42. Finally, the relay coil 146 also closes a switch 171 which activates the metal detectors 24 to determine whether the robber possesses a gun.

Figure 8:
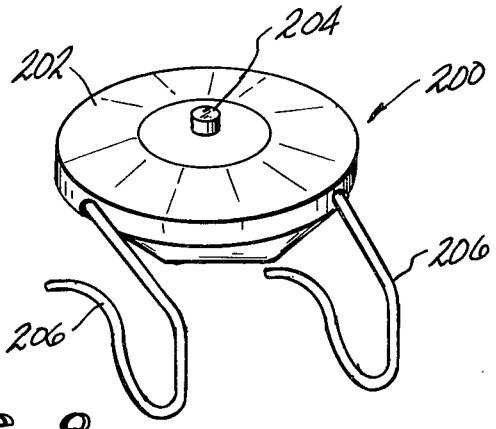
FIG. 8 is a perspective view of a miniature transmitter which is adapted for placement in the target packet of currency handed to the robber.

Referring now to FIG. 8, there is shown a preferred embodiment of the miniature radio transmitter, denoted generally by the numeral 200, which is implanted in the target packet of money which will be handed to the robber. The transmitter 200 is contained in a casing 202 which is approximately the size of a half dollar. The transmitter 200 is battery operated with a self-contained battery, and the transmitter includes a reciprocal on-off switch 204 which projects from the casing 202 and is normally biased to an "on" position wherein the transmitter 200 will transmit its narrow wave length signal. As previously noted, the transmitter 200 has an effective signal transmitting range of about one mile. A pair of spring clips 206 may be attached to the casing 202 to enable the transmitter 200 to be clipped to the inside of the packet of money in which the transmitter 200 is concealed. Other securement means, such as double-sided sticky tape or the like, may be used in lieu of the spring clips 206 to secure the transmitter 200 inside of the packet of money. As noted, the switch 204 is normally biased to an "on" position wherein the transmitter 200 is operable to transmit its signal. Thus, when the transmitter 200 is stored in the compartment 56 in the cash drawer 46, provision must be made for maintaining the transmitter 200 in its "off" mode.

Figure 9:
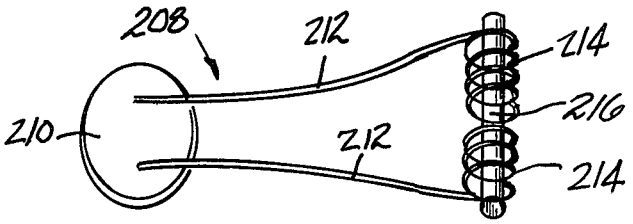
FIG. 9 is a plan view of a spring biased pressure pad which is mounted in the cash drawer compartment holding the target packet of currency.
Figure 10:
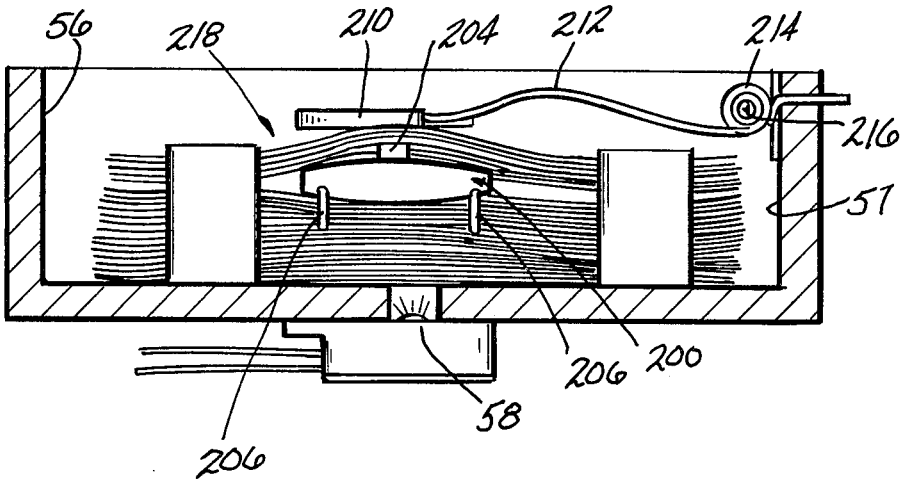
FIG. 10 is a sectional view of the cash drawer compartment showing the positioning of the target packet of currency therein.

To this end, a control device denoted generally by the numeral 208, see FIGS. 9 and 10, is mounted in the cash drawer compartment 56. The control device 208 preferably includes a pressure pad 210 which is mounted on a pair of arms 212 extending from torsion springs 214. The torsion springs 214 are mounted on a pin 216 which is secured to the side wall 57 of the cash drawer compartment 56. Thus, the pressure pad 210 is biased in a downward direction as viewed in FIG. 10. The packet of money 218 is disposed in the compartment 56 overlying the sensor 58 so the sensor 58 will not be activated. It should be noted that the pressure pad 210 will not be aligned with the sensor 58 so that when the cash packet 218 is removed from the compartment, the pad 210 will not prevent the sensor 58 from being activated. It will be seen that the transmitter 200 is disposed inside of the stack of bills in the packet 218, so as not to be visible, and is held in place by the spring clips 206. The pressure pad 210 presses down on the top of the packet 218 thereby pressing the on-off button 204 to an "off" position. Thus, so long as the packet 218 remains in position in the compartment 56, the transmitter 200 will be in the "off" mode. When the packet 218 is removed from the compartment 56, the button 204 is released from being influenced by the pad 210, and the button 204 will automatically shift to its "on" position to turn the transmitter 200 on. A miniature receiver is also disposed in the compartment 56, preferably in the pressure pad 210, and is operable to ensure that the transmitter 200 is "off" when contained in the compartment 56, and that the transmitter 200 actually turns on when it is removed from the compartment 56. Each receiver operates a signal light at the respective teller stations which will light up when transmission by the transmitter 200 is detected. The receiver is also used for daily spot checks of the transmitters 200 which are performed by the tellers momentarily lifting the pressure pad 210 and observing the signal light. In this way, malfunctioning transmitters will be detected and replaced. The transmitter check light 173 operates from a switch 175 (see FIG. 7) which closes when the receiver in the cash drawer hears a signal from the transmitter 200.

In the event that the robber takes a hostage with him when he enters the lobby after the robbery, the system of this invention has a provision for releasing the robber and hostage from the lobby to the outside of the bank. There may be one or more switches at various locations in the bank where bank management personnel override the outside lobby door locking system to open the outside lobby doors in the event that the robber has a hostage in the lobby. The secondary override switch 177, when closed, energizes a coil relay 179 which closes a switch 181 to maintain the coil relay 179 in its energized state. It will be noted that this will only occur when switch 100 is closed. The coil relay 179 opens switch 183 to de-energize outer door solenoid 114 and open motor contacts 112. The coil relay 179 also closes switch 185 to energize motor contacts 128 whereby the outer lobby doors will automatically open. The robber will then be free to leave with the hostage. It will be noted that the robber will still have the target currency packet in his possession, and that the police will be able to track the robber after leaving the bank by reason of the transmitter 200. The coil relay 179 also closes switch 197 and opens switch 201 so that after the robber leaves the lobby, people can enter the lobbies from the bank proper by closing switch 122 to activate coil relay 133, which then closes switch 199 to activate time delay 143. Time delay 143 will then unlock and open the inner lobby doors.

When the robber has been detained in the lobby until police arrive, when the police desire to release the robber from the lobby to take him into custody, the door opening mechanism 40 on the outside wall of the bank is used to open the outer lobby doors 34. As noted, the mechanism 40 operates with a magnetic card or with a special key, and when operated, it closes a switch 187 which activates a coil relay 189. The coil relay 189 opens a switch 191 to de-energize outside door lock solenoid 114 and de-energize outside door closing motor contacts 112. At the same time, coil relay 189 closes switch 193 to energize outside door opening motor contacts 128 to open the outside lobby doors.

It will be noted that the entire security circuit is provided with back-up battery power 195 in case of power failure in the building.

It will be readily appreciated that the security system of this invention can be installed in bank premises with modular wall components which are electrically connected to each other. The majority of the electrical components and circuitry can be installed in the walls of the lobby structure per se. Connections to bank proper locations can be made through drop ceilings or the like. The system will operate without the robber being aware of it, and has various safety factors built into it in the event of unforeseen occurrences. The lobbies will not trap bank customers due to the need of possessing the hidden transmitter to open the inner lobby doors.

Since many changes and variations of the disclosed embodiment of the invention may be made without departing from the inventive concept, it is not intended to limit the invention otherwise than as required by the appended claims.

What is claimed is:

1. A security system for a bank building or the like having a main business area wherein money transactions are carried out, said building being accessible to the public only through one or more lobbies having motor operated outer and inner doors wherein the outer doors allow access between outside the building and the lobbies and the inner doors allow access between the lobbies and the main business area, said system comprising:

(a) first manually operable means for opening the outer lobby doors to enter the lobbies from outside the building;

(b) second manually operable means for opening the inner lobby doors to enter the main business area from inside the lobbies;

(c) third manually operable means for opening the inner lobby doors to enter the lobbies from the main business area;

(d) fourth manually operable means for opening the outer lobby doors to exit the lobbies to outside the building;

(e) means inside the main business area having a plurality of compartments for holding currency, one of said compartments having sensor means therein for detecting the presence or absence of a currency packet in said one of said compartments;

(f) door locking means for locking said inner and outer lobby doors in a closed position when said sensor means detects the absence of a currency packet in said one of said compartments;

(g) means for disabling said first, second, third and fourth manually operable means from opening said lobby doors when the latter are locked by said locking means;

(h) narrow wavelength radio receiver means mounted adjacent said inner lobby doors in said main business area, said receiver means having a limited signal reception range on the order of several feet;

(i) a miniature radio transmitter concealed in a packet of currency normally disposed in said one of said compartments, said transmitter emitting a radio signal of the same wavelength as said receiver means; and (j) means operably connected to said receiver means for temporarily enabling said third manually operable means only to open said inner lobby doors when said transmitter is within the effective receiving range of said receiver.

2. The security system of claim 1, further comprising means in said one of said compartments for preventing said transmitter from transmitting a radio signal while said packet of currency remains in said one of said compartments.

3. The security system of claim 2, further comprising miniaturized radio signal receiver means associated with said one of said compartments to detect operation of said transmitter, and indicator means operably connected to said miniaturized radio signal receiver means to provide a visual indication of the operability of said transmitter.

4. The security system of claim 1, further comprising manually operable override means for selectively overriding said door locking means to open said lobby outer doors only.

5. The security system of claim 1, further comprising metal detector means adjacent said lobbies for detecting firearms on the person of one located in said lobbies, and means for actuating said metal detector means in response to detection of a radio signal by said receiver means.

6. The security system of claim 1, further comprising means mounted outside of the building for use by security personnel for selectively opening said lobby outer doors only.

7. The security system of claim 1, further comprising means operably connected to said sensor means for operating a camera to film occurrences in the main business area of the building when said sensor means detects the absence of a currency packet in said one of said compartments.

8. The security system of claim 1, further comprising means operably connected to said sensor means for activating a warning sign located outside of said building when said sensor means detects the absence of a currency packet in said one of said compartments.

9. The security system of claim 1, further comprising means operably connected to said receiver means for activating audio message transmitters located in said lobbies and intercom units located in said lobbies and in the main business area of said building, and outside of said building when said receiver means receives a radio signal from said miniature radio transmitter.

10. For use in a building security system, a lobby construction comprising:

(a) inner, outer, top and side walls operable to form a lobby through which persons must pass to enter and leave the building;

(b) inner and outer lobby doors operable to open and close by sliding into and out of said inner and outer walls;

(c) locking means in said lobby walls operable to lock said inner and outer doors in a closed position;

(d) first manually operable means in said outer wall for opening said outer lobby doors from outside of the lobby to allow entry into the lobby through said outer lobby doors;

(e) second manually operable in said inner wall for opening said inner lobby doors from inside of the lobby to allow exit from the lobby through said inner lobby doors;

(f) third manually operable means in said inner lobby wall for opening said inner lobby doors from outside of the lobby to allow entry into the lobby through said inner lobby doors;

(g) fourth manually operable means in said outer lobby wall for opening said outer lobby doors from inside the lobby to allow exit from the lobby through said outer lobby doors;

(h) means in said lobby walls for selectively actuating said locking means;

(i) narrow wavelength radio signal receiving means in said inner wall, said radio signal receiving means having an effective receiving range on the order of several feet; and (j) disabling means in said lobby walls operably connected to said radio signal receiving means and to said locking means, said disabling means being operable to disable said locking means to the extent that only said third manually operable means will be operable to open said inside lobby doors when a proper wavelength radio signal is received by said radio signal receiving means.

11. The lobby construction of claim 10, further comprising intercom means mounted in said lobby walls, and means operably interconnecting said radio signal receiving means and said intercom means for activating the latter upon receipt of a proper wavelength radio signal by said radio signal receiving means to enable voice communication between persons located inside and outside of said lobby.

12. The lobby construction of claim 10, further comprising metal detector means disposed in said lobby walls, and means operably interconnecting said radio signal receiving means and said metal detector means for activating the latter upon receipt of a proper wavelength radio signal by said radio signal receiving means.

13. The lobby construction of claim 10, further comprising audio tape playing means disposed in said lobby walls, and means operably interconnecting said radio signal receiving means and said audio tape playing means for activating the latter upon receipt of a proper wavelength radio signal by said radio signal receiving means.

14. The lobby construction of claim 10, further comprising means mounted in said outer wall outside the building for use by security personnel for selectively opening said lobby outer doors only.

* * * * *